United States Patent [19]

Shults

[11] 4,203,174

[45] May 20, 1980

[54] AUTOMATIC SWIMMING POOL COVER AND COVER WASHER

[76] Inventor: Neal Shults, 2844 Knoxville Ave., Long Beach, Calif. 90815

[21] Appl. No.: 932,523

[22] Filed: Aug. 10, 1978

[51] Int. Cl.[2] ..... E04H 3/19; B08B 3/02

[52] U.S. Cl. ..... 4/172; 4/172.14; 134/122 R; 160/23 R

[58] Field of Search ..... 4/172, 172.12–172.14, 4/233, 185 L, 173 R, 152–154, 172.11; 134/64 R, 122 R, 111; 160/271, 311, 345, 23

[56] References Cited

U.S. PATENT DOCUMENTS

| | | | |
|---|---|---|---|
| Re. 25,078 | 11/1961 | McGuire | 4/172.14 |
| 2,754,899 | 7/1956 | Karobonik et al. | 4/172.14 |
| 2,754,906 | 7/1956 | Karobonik | 4/172.14 |
| 2,786,522 | 3/1957 | Weber | 160/345 |
| 2,958,083 | 11/1960 | Shook et al. | 4/172.14 |
| 3,019,450 | 2/1962 | Karasiewicz | 4/172.14 |
| 3,050,743 | 8/1962 | Lamb | 4/172.14 |
| 3,076,975 | 2/1963 | Lamb | 4/172.14 |
| 3,273,171 | 9/1966 | Lamb | 4/172.14 |
| 3,499,174 | 3/1970 | Carey | 4/172.14 |
| 3,501,783 | 3/1970 | Broadman | 4/172.14 |
| 3,860,020 | 1/1975 | King, Jr. | 134/111 |
| 3,982,286 | 9/1976 | Foster | 4/172.14 |
| 4,001,900 | 1/1977 | Lamb | 4/172.14 |
| 4,060,860 | 12/1977 | Lamb | 4/172.14 |

FOREIGN PATENT DOCUMENTS

| | | | |
|---|---|---|---|
| 2439955 | 8/1975 | Fed. Rep. of Germany | 4/172.14 |

*Primary Examiner*—Stuart S. Levy

*Attorney, Agent, or Firm*—Fulwider, Patton, Rieber, Lee & Utecht

[57] ABSTRACT

A motorized automatic swimming pool cover is provided with a non-reversible motor, opening and closing limit switches and with an automatic washing system that cleans the cover as it is retracted onto a roller.

10 Claims, 5 Drawing Figures

FIG. 3
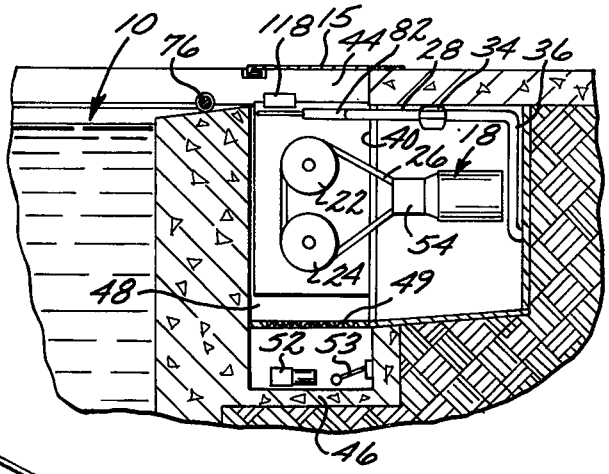
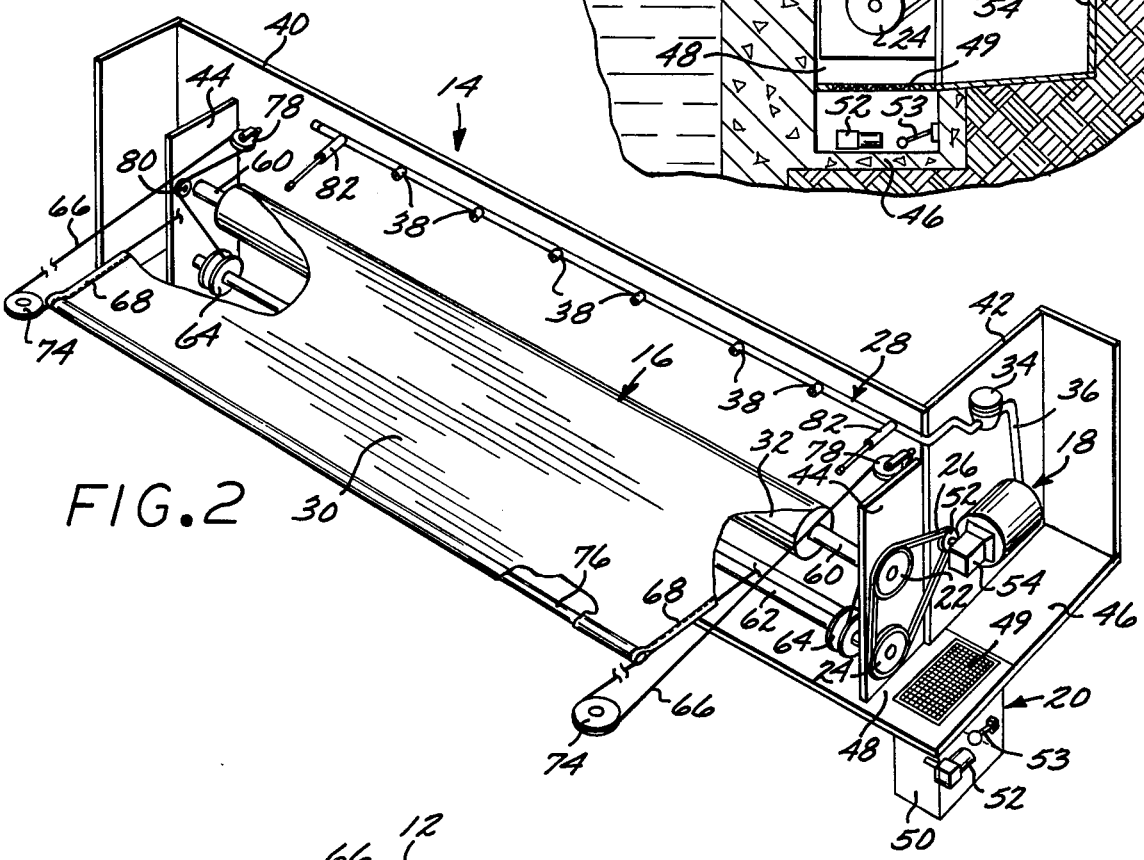
FIG. 2
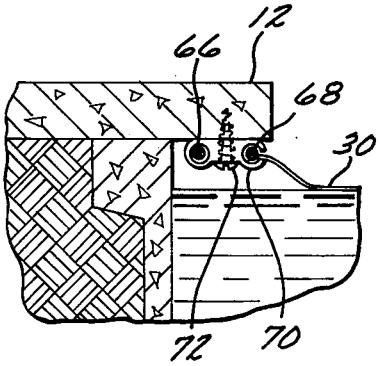
FIG. 4
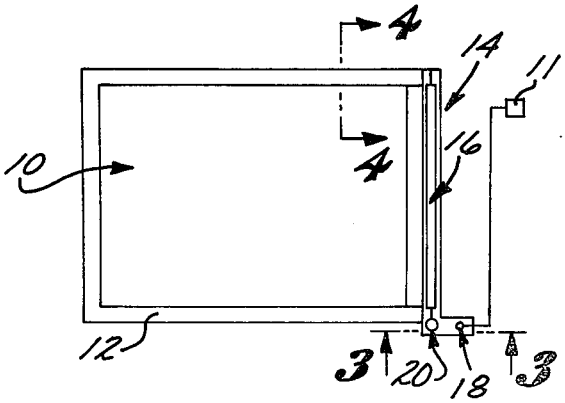
FIG. 1

AUTOMATIC SWIMMING POOL COVER AND COVER WASHER

BACKGROUND OF THE INVENTION

1. Field of the Invention

The present invention relates to automatic swimming pool covering and protection devices.

2. Description of the Prior Art

Various motorized swimming pool covering devices have been devised in the past. Such systems typically employ a large expansive tarpaulin which is wound in coiled fashion about an elongated cylindrical roller at one end of a swimming pool. When it is desired to cover the pool, a transverse cross beam, firmly attached to the free end of the tarp, is pulled by a motor driven cable to unwind the tarpaulin from the roller and draw it across the swimming pool to cover the pool. The cover is constructed of a flexible, durable, water impervious material, such as laminated vinyl, sometimes reinforced with a tightly woven dacron mesh. Nylon or dacron ropes or cords are sewn or integrally formed into the lateral edges of the cover material. The distance between the ropes is greater than the breadth of the pool so that when the cover is drawn from its roller, the pool is completely covered. The ropes embedded or entrapped in the edges of the pool cover form beads along the cover edges and are restrained from lateral movement by elongated parallel tracks on either side of the pool having C-shaped openings facing inward toward the center of the pool. The ropes extend beyond the transverse cross beam at the front of the tarpaulin to serve as cables which are used to draw on the tarpaulin to pull it into position to cover the pool. The cables typically pass about pulleys at the end of the pool remote from the tarpaulin roller and return the length of the pool to take up reels located proximate to the tarpaulin roller.

In conventional systems, a reversible motor is provided to alternatively draw on the take up reels to pull the cover into position over the pool, or to drive the tarpaulin roller to retract the tarpaulin from the pool so that the pool is free for use. Such a motor typically operates at 110, 115 or 120 volts, a.c., and is of a $\frac{1}{4}$ or $\frac{3}{8}$ horsepower rating. The motor, tarp roller, rope reels and other actuating mechanisms for extending and retracting the cover may be located either above grade, or below grade in a specially designed container or recess. When located below grade, leaves, grass clippings and other debri which falls upon the pool cover is withdrawn from atop the pool when the cover is retracted. However, in such conventional systems no provision is made for actually cleaning the cover. Rather, this debris is simply carried to just beyond the end of the pool where it falls into a below grade trench housing the actuating components for the automatic pool cover. In above grade systems, the debris is carried to beyond the end of the pool with retraction of the cover, but is free to blow back into the pool. As a consequence, dirt and debris are frequently blown or washed into the pool by the wind during retraction or extension of the cover, and by rain water which falls on the cover and washes it into the pool. In addition, since no positive cover cleaning mechanism exists, leaves, dirt and other light debri frequently become stuck to the cover and do not fall off behind the tarp roller when the tarpaulin is retracted. In addition, to presenting a danger of contaminating the pool, such debris is very unsightly and detracts significantly from the aesthetic appearance of the pool when the pool is covered.

SUMMARY OF THE INVENTION

It is an object of the present invention to provide a motorized swimming pool cover with an automatic tarpaulin washing system. The washing system includes a plurality of sprayer jets spaced longitudinally and positioned directly behind the tarp roller. The jets are located closely enough together so that the water spray therefrom is dispatched in overlapping fashion to completely wash the cover as it is retracted. The wash water, carrying the leaves, dirt and other material, falls into the trench for the automatic pool cover behind the tarp roller and is prevented from washing into the pool. Preferably, the tarp roller is located below grade, where a wall or bond beam extends downward either below the tarp roller or forward therefrom to separate the trench from the pool. Drain water from the trench drains laterally into a wash well, and then into a sump pump well. When the sump pump well fills to a predetermined level, as determined by a conventional sump limit switch, the sump pump motor pumps the wash water from the sump pump well into a sewage system. This effectively prevents contamination of the swimming pool and enhances the appearance of the pool cover when the cover is in the extended position atop the pool.

In its preferred embodiment the invention provides a brief delay between the time that an electrical signal is generated to actuate retraction of the tarp roller, and the time that the roller is actually engaged to retract the cover. This delay allows time for sufficient water pressure to build up in the sprayer jet manifold system before the tarp is actually wound onto its roller. As a consequence, it is possible to clean the tarp entirely from one end to the other as it is retracted onto its roller. If a delay were not introduced, the first few feet of the tarp rolled onto the roller would not be completely clean, since adequate water pressure from the sprayers would not initially be present.

A further object of the invention is to provide an automatic pool cover system in which a single direction motor may be employed. As previously noted, in conventional pool cover actuating systems, the motor employed must be a reversible motor. These motors are much more expensive than motors which drive a shaft in a single direction of rotation. However, because it is necessary to both retract and extend the pool cover, a reversible motor has heretofore been required. By means of the present invention, however, a system is provided in which a non-reversible motor is used to both extend and retract the tarpaulin. This is achieved by positioning an electric clutch at the ends of both the tarp roller and the tarp extension rope winding reels. The pulleys of both of the electric clutches are driven during the entire time that the drive motor is actuated to either extend or retract the tarp. However, only the electric clutch associated with the desired movement of the tarp is actuated to engage the associated drive. Moreover, electrical circuitry is provided to lock out and prevent actuation of the clutch associated with the drive not selected. This prevents concurrent operation of both the tarp retracter and tarp extender, which could otherwise seriously damage the pool cover.

By utilizing a fabric or rubber drive from the single direction electric motor driving the pulleys of the electric clutches, a further advantage is achieved. Specifically, the electric clutches are totally electrically isolated from the drive motor. The drive motor is operated at relatively high 110–120 volt, 60 cycle a.c. current. Since the equipment components are operated in the vicinity of water, an extreme danger of a potentially fatal electrical shock normally exists in most conventional automated pool cover systems. However, by electrically isolating the drive motor from the electric clutches that are associated with the tarp roller and the tarp rope winding reels, the possibility of electric shock is eliminated from the clutch and pool cover limit switch circuitry. Only low voltage, direct current, is required to activate the electric clutches, the limit switches associated with the opened and closed positions of the cover, and the latching relays associated therewith. By eliminating any electrical contact with the 110–120 a.c. voltage line, a system with improved safeguards is provided.

Safety is improved still further by locating latching relay contacts and the commercial a.c. power source appearances in a control panel remote from the electric drive motor, some distance away from the pool. The latching relay contacts are coupled to the a.c. supply which also extends to the drive motor. By providing contacts at a remote control panel, the higher voltage a.c. extends to the drive motor only during the time that the drive motor is either retracting or extending the pool cover. At all other times, the commercial a.c. power stops at the control panel, and does not travel to the electric motor. As a consequence, any short circuit condition or other malfunction in the motor line does not expose a person in the vicinity of the pool to the hazards of a high voltage electrical shock, except during the time that the motor is actually operating.

In this same connection, a further feature of the invention is the provision of low voltage d.c. current to operate the electrical clutches, the limit switches, the latching relays, the tarp washer solenoid, and the sump switch and pump. As with the safe guards applied to the a.c. drive motor, the electrical isolation of the d.c. elements, and operation of the d.c. elements at a low voltage, such as, for example, 12 volts d.c., provides an added margin of safety to any person in the vicinity of the actuating components of the cover drive and cleaning mechanism.

A further feature of the present invention is the provision of latching relays and limit switches associated with the manually operated push button switches to extend and retract the tarp. In contrast to conventional systems, even momentary actuation of the manually operated retract and extend switches will cause the drive system to fully extend or retract the tarp, as desired. With conventional systems, a person desiring to extend or retract the pool cover must keep the actuating button depressed until the pool is fully covered or uncovered. Premature release of the button will stop the movement of the tarp at that point. This represents a considerable inconvenience, as in most cases the person actuating the drive mechanism desires merely to initiate the movement of the tarp then leave the control panel, and for the system itself to be self-executing. With the present invention, this is achieved by means of latching relays, which keep the actuated clutch engaged until the circuit is broken by the limit switches associated with the position of extreme movement of the tarp. Another manually operated switch is located in circuit with both the switches for opening and closing the cover. This switch is used to automatically stop movement of the tarpaulin should some abnormal condition occur. In this way, an individual is not helpless to prevent continuation of movement of the tarp should such movement be undesirable for any reason.

The various features, advantages, and structure of the invention may be explained with greater clarity and particularity by reference to the accompanying drawings.

DESCRIPTION OF THE DRAWINGS

FIG. 1 is a plan view diagrammatically illustrating the location of system components relative to a pool.

FIG. 2 is a perspective view of the actuating components of the motorized pool cover system.

FIG. 3 is a side sectional elevational view taken along the lines 3—3 of FIG. 1.

FIG. 4 is an elevational sectional detail taken along the lines 4—4 of FIG. 1.

DESCRIPTION OF THE EMBODIMENT

Figure 5:
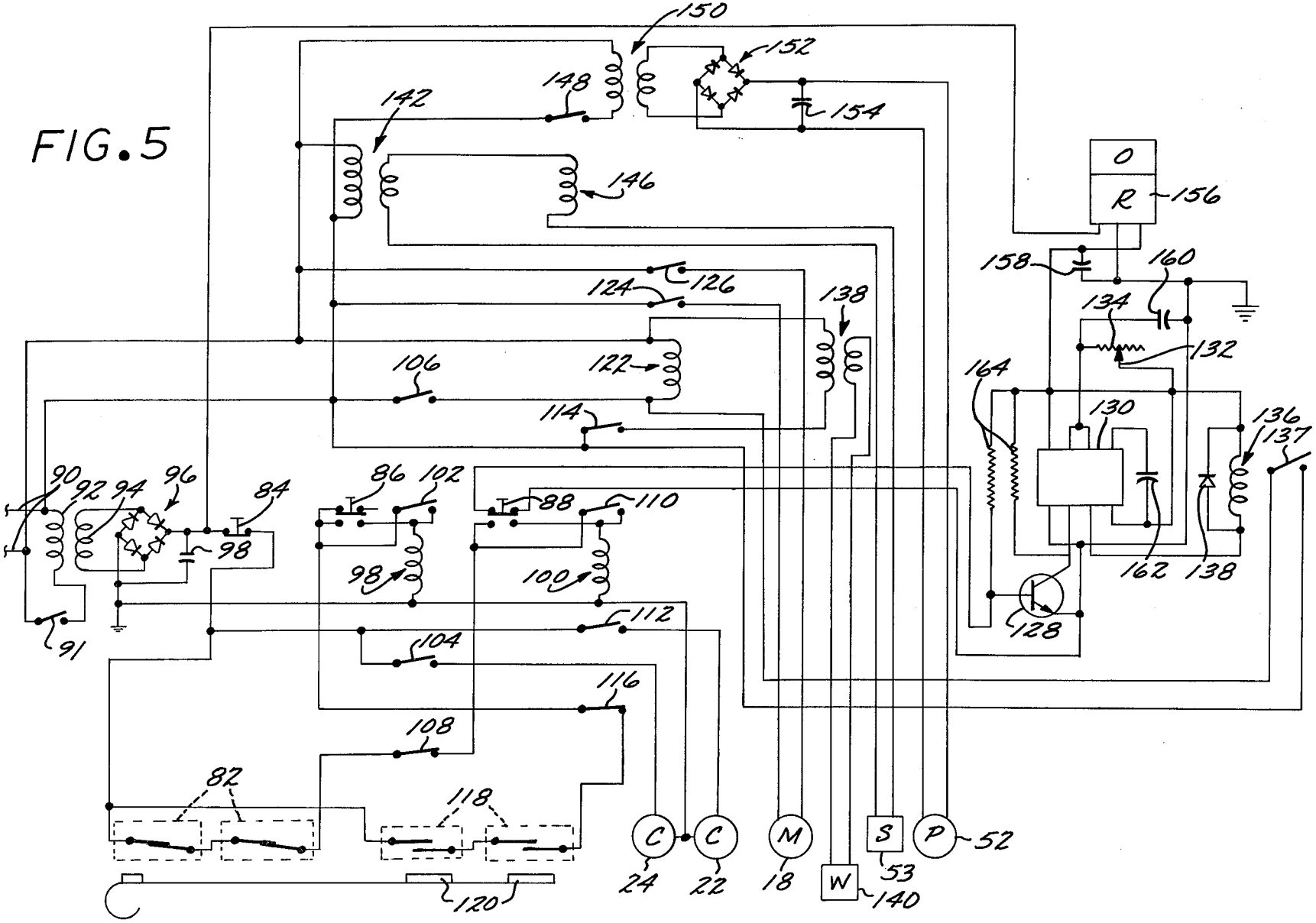
FIG. 5 is an electrical schematic diagram of the control circuitry of the invention.

With reference to FIG. 1, a rectangular pool 10 is illustrated encircled by a walking deck 12 about the perimeter thereof. At one end of the pool there is an L-shaped trench 14 which houses the actuating components of the motorized pool cover system. These components include an elongated cylindrical tarp roller assembly 16, a single speed, single direction drive, 60 hertz a.c., 110–120 volt motor 18, and a sump pump assembly 20. A control panel 11 is located some distance away with electrical connections to the actuating components. An aluminum cover 15 is provided above the trench 14 for safety and aesthetic reasons, and is illustrated in FIG. 3.

The operating components of the system are depicted in detail in FIG. 2. It should be noted that the single direction motor 18 is connected to electrical clutches 22 and 24 by a V-belt 26. The V-belt is constructed of a flexible, nonconductive material, such as rubber, plastic or fabric so that the motor 18 is electrically isolated from the other operating components of the system.

An elongated tarp spraying manifold cleaning water pipe 28 is located immediately to the rear of the laminar plastic tarp 30 which is wound on the cylindrical roller 32. The tarp spraying pipe 28 includes an in-line water control 34, that includes a solenoid for a valve that emits water to the cleaning water pipe 28. A conventional plumbing water supply line 36 is connected to the water control 34. A series of uniformly spaced water jets 38 located at uniform intervals along the length of the cleaning water pipe 28 are directed at the tarp 30 as it passes downward at a vertical tangent relative to the cylindrical roller 32. The cleaning water pipe 28 is connected by brackets or other conventional means (not shown) to fiberglass mounting slabs 40 and 42 which are arranged in the trench 14 in an L-shaped orientation to define the back mounting walls or the operating components of the motorized pool cover system. Fiberglass mounting panels 44 extend forward perpendicular from the back wall 40 in the direction of the pool 10. A slab floor 46, preferably fiberglass, located beneath the partitions 40,42 and 44.

It should be noted that the partitions 44 do not extend all the way to the slab floor 46. Rather, there is a slot-like aperture at 48 beneath the partitions 44 sufficient to allow the passage of drain water. Also, the slab floor 46 is canted slightly toward a drain grate 49 above a sump pump assembly 20, so as to allow cleaning water used to wash the tarp 30 to flow thereacross and into a fiberglass sump pump well 50, visible in FIGS. 2 and 3. A sump pump 52, operated under the control of a water level switch 53, is used to pump drain water used to wash the tarp 30 into a sanitary sewer line.

As illustrated in FIG. 3, the single direction ¼ horsepower motor 18 is used to drive both of the rims of pulleys of the electrical clutches 22 and 24 through the V-belt 26 whenever it is actuated. The electric motor 18 powers a drive pulley 52, visible in FIG. 2, through a speed reducing gear box 54. The motor 18 is physically connected to the partition 42 by means of brackets held by anchors passing into the concrete partition 42.

A bearing mount about the electrical clutch 22 allows an axial shaft to turn freely relative to the partition 44. A tarp retractor drive shaft 60 is interiorally located relative to the pulley 22 and is connected to the structure of the cylindrical tarp roller 32. The tarp roller drive shaft 60 is journaled into a corresponding bearing in the opposite partition 44 to hold the cylindrical tarp roller 32 in horizontal alignment directly in front of the spray nozzles 38 of the cleaning water pipe 28. Similarly, the electric clutch 24 is mounted in bearings in the partition 44 and is located directly beneath the electric clutch 22. The electric clutch 24 receives an axial tarp extending drive shaft 62, and engages the drive shaft 62 in rotation when the electric clutch 24 is actuated. At either end the tarp extending drive shaft 62 carries coaxially mounted cable reels 64 for receiving Dacron cable line 66 as it is wound thereon. The cable line 66 is embedded into the structure of the 15 ounce, laminated vinyl tarp 30, which is reinforced with a tightly woven dacron mesh. The cable 66 is in the edges of the tarp 30 forms parallel beads 68, illustrated in FIG. 4. The beads 68 are carried in inwardly facing C-shaped cavities in longitudinally extending parallel sections of track 70. The track 70 is fastened by bolts 72 to the underside lip of the deck 12 of the swimming pool. The bead 68 thereby rides in the inwardly facing corresponding C-shaped cavities in the parallel sections of the track 70 as the tarp 30 is retracted and extended.

Opposite the trench 14 at the other end of the pool 10 are located horizontally disposed pulleys 74, visible in FIG. 2. The cable 66, extending from the transverse cross beam 76 of the tarp 30 passes about the pulleys 74 and returns toward the control well 14. Return of the cable 66 is through a circular aperture in the track 70 exteriorally located from the C-shaped portion of the track 70, illustrated in FIG. 4. Thus, each cable 66 traverses the length of the swimming pool on either side thereof from the laterally disposed pulleys 74 and passes about corresponding horizontally mounted pulleys 78 attached to the back wall 40, visible in FIG. 2. From the pulleys 78, the cables pass across other guide pulleys 80 attached to the partitions 44 and onto the cable winding reels 64.

It should be noted that while the transverse cross beam could be formed of aluminum or some other rigid material, preferably it is constructed of a cylinder of styrofoam. The styrofoam cylinder 76 is sewn into the leading edge of the tarp 30, similar to the manner of attachment of the cable line 66. The leading edge of the tarp 30 thereby floats on the surface of the water. This prevents leaves, grass and other debris from being blown under the tarp 30, as so often occurs with swimming pool covers in which the leading edge of the tarp is raised above the surface of the water.

Magnetic reed switches 82 are located at either end of the cleaning water pipe 28 to signal when the tarp 30 has been fully retracted and wound onto the cylindrical roller 32. When this occurs, the cross beam 76 at the forward edge of the tarp 30, depresses the feeler rods extending outward toward the pool from the switches 82. Pressure on these feeler rods brings the magnets, coupled thereto, into registration with internal reed switch components. Actuation of the switches 82 indicates that the cover is fully open. Conversely, corresponding reed limit switches 118 located on brackets of the pool, visible in FIG. 5, signal when the cross beam 76 has arrived in place to fully close or cover the pool 10 with the tarp 30. When this occurs magnets, physically bolted to the tarp 30, arrive in registration with reed switch components internally located within the structure of the switches 118. Such registration actuates the switches 118.

With reference to FIG. 5, three main manually operated push button controls 84, 86 and 88 are provided. 110 or 120 volt, 60 hertz a.c. current, supplied from a commercially available public utility, is provided on lines 90. An off/on safety switch or fuse 91 is located in series with lines 90. The current passes through the primary 92 of a step down transformer. The output of the secondary 94 of the transformer is passed through a rectifying bridge 96 and across a large smoothing capacitor 98. The push button 84 is a STOP switch which, when depressed, opens the electrical circuit to both of the electric clutches 22 and 24. The contacts of the STOP button 84 are normally closed, but when opened, power is removed from both of the clutches 22 and 24 to prevent further movement of the tarp 30.

A latching relay 98 is actuated by a CLOSE manual push button 86 to close the normally open contacts 102, 104 and 106, and to open the normally closed contact 108. Push button 86 thereby enables electric clutch 24 to close the pool cover. Similarly, the latching relay 100 is associated with the manually operable OPEN push button 88 to close the normally opened contacts 110, 112 and 114, and to open the normally closed contact 116.

Push button 88 thereby opens the pool cover. The normally closed contacts 108 and 116 are respectively associated as disabling contacts with the electric clutches 22 and 24. That is, depression of the CLOSE push button 86 will open the contacts 108. When contacts 108 are open, there is an open circuit condition relative to the latching relay 100, so that depression of the push button 88, while the relay 98 is latched, will have no effect, since no current can flow through the open contacts 108. Conversely, depression of the OPEN push button 88 will open the contacts 116. This prevents current from reaching the latching relay 98, even if push button 86 is depressed. It can be seen, therefore, that the circuitry of the invention includes a safeguard, whereby depression of the CLOSE push button 86 disables operation of the electric clutch 22 until the latching relay 98 is unlatched. Depression of the OPEN push button 88, similarly disables actuation of the electric clutch 24 until after latching relay 100 has become unlatched.

The latching relays 98 and 100 are respectively unlatched by opening of the OPEN limit switches 82 and by opening of the CLOSE limit switches 118. As previously noted, the limit switches 82 and 118 are read switches which are activated by magnet 120, positioned as previously described. When magnets 120 are in the vicinity of either the switches 82 or the switches 118, they open the normally closed limit switches.

When the CLOSE manual push button 86 is depressed, the latching relay 98 closes contacts 106, as previously noted. This completes a circuit to another relay 122, which in turn closes contacts 124 and 126. Closure of the contacts 124 and 126 provide 110 volt power to the single direction ¼ horsepower motor 18. It should be noted that closure of the close switch 86 is accompanied by immediate actuation of the motor 18, subject only to the delay in operation of the relay 122. On the other hand, when the open push button 88 is depressed, a different series of events occurs.

Operation of the OPEN button 88 results in latching of the latching relay 100. Operation of the push button 88 to latch the relay 100 is accomplished by opening of a circuit to the base of a transistor 128. Opening of this circuit opens the base-emitter connection of the transistor 128 and thereby causes a voltage pulse to appear at the collector of transistor 128 as an input to pin 2 of a conventional oscillator 130. The oscillator 130 may be a conventional, adjustable frequency timing oscillator, such as a 555 timer. The frequency of oscillator 130 is adjusted by alteration of the position of the wiper 132 relative to the resistor 134.

Application of a voltage pulse to pin 2 actuates the timer 130 which delivers output pulses at pin 3 to a relay 136. The output pulse at pin 3 only occurs, however, after the cyclic delay of the timing oscillator 130. Once an input pulse appears on pin 2 to timer 130, and the timer 130 times out, the output pulse from pin 3 triggers operation of the relay 136. A rectifying diode 138 is connected in parallel across the coil of the relay 136. Operation of the relay 136 closes contacts 137 and completes a circuit through the relay 122 to latch contacts 124 and 126 to draw 110–120 volt current thereto from input lines 90. Closure of contacts 124 and 126 thereby operates the motor 18, after the programmed delay determined by adjustment of the timing oscillator 130.

The reason for the programmed delay to temporarily inhibit actuation of the motor 18 is to allow time for a sufficient head to build up in the cleaning water pipe 28. Immediately upon actuation of the OPEN push button 88, and prior to closure of the contacts 124 and 126, the latching relay 100 closes the contact 114. This provides voltage to a step down transformer 138 which provides low voltage current, such as 12 volts, to the tarp washer solenoid 140, located in the water control 34 for the tarp washing system. Actuation of the solenoid 140 opens a valve from water inlet pipe 36 in FIG. 2 to the transverse cleaning water pipe 28. Very shortly a sufficient pressure head is built up in pipe 28 for water to be expelled in overlapping sprays onto the tarp 30 from the water jets 38. All of this occurs prior to rotation of the tarp roller 32, since the drive motor 18 does not drive the V-belt 26 until actuated by the delayed output of the oscillator 130.

As previously noted, the wash water is discharged into a sewage drain by means of a sump pump 52 located to a sump pump well 50. The sump pump switch 53 is a conventional float or pressure type of switch typically used in sump pump installations. The sump pump switch 53 receives power through a step down transformer 142. When the sump pump switch 53 is closed, an output is provided to the relay 146. This only occurs if water in the sump pump 50 has risen sufficiently to trip the switch 53. When relay 146 is energized, the relay contact 148 is closed. This closes a circuit to another step down transformer 150 to provide voltage to another rectifying bridge 152. Voltage from the bridge 152 is smoothed by a smoothing capacitor 154, and passed as an input to a low voltage, direct current operated sump pump 52.

Sump pump 52 is typically operated at a low level d.c. voltage, for example 12 volts. Similarly, a 12 volt supply may be trapped for use to power the timing oscillator 130 through a conventional d.c. voltage regulator 156, in the manner depicted.

Other components in the control of oscillator 130 include a 200 microfarad capacitor 158, a 58 microfarad capacitor 160, and a 0.01 microfarad capacitor 162. Resistors 164 are 10 K ohms each. Transistor 128 is preferably a 2N2222 transistor. The potentiometer formed by the wiper 132 and resistor 134 is a 500 K potentiometer.

It should be noted that with the exception of the limit switches 82 and 118, the electric clutches 22 and 24, the electric motor 18, the sump pump 52, sump switch 53, and the washer solenoid 140, all of the electrical components in FIG. 5 are located in the control panel 11 of FIG. 1. The only high voltage (110–120 volts a.c.) which is directed to the automatic cover control trench 14 is the voltage carried on the lines to the drive motor 18. Furthermore, voltage is only carried on these lines when the motor 18 is actually in operation. It should therefore be appreciated that with a minimum number of high voltage connections in the vicinity of the swimming pool 10, an added measure of safety is provided to individuals in the area. Moreover, the drive motor 18 is electrically isolated from the other components in the trench, since the only physical connection thereto is through a nonconductive V-belt 26. In this manner, the motor 18 is electrically isolated from the other system components.

The operation of the system may be described as follows. Should it be desired to close the cover afforded by the tarp 30 across the expanse of the pool 10, the off/on switch 91 is closed and the CLOSE button 86 is depressed. Depression of the push button switch 86, even momentarily, provides a sufficient current to the latching relay 98 to achieve self-latching through the contact 102. In addition, power is provided to engage the electric clutch 24, which in turn engages the tarp extension drive shaft 62 in FIG. 2. Rotation of the drive shaft 62 draws on the dacron cable 66 to pull the transverse cross beam 76 across the pool, with the beads 68 riding in the tracks 70 so that the pool 10 is covered with the tarp 30. Power is provided to the drive motor 18, since latching relay 98 closes contact 106 to enable the relay 122. This in turn closes contacts 124 and 126 to provide power to the drive motor 18, which rotates the pulley of the electric clutch 24 by means of the V-belt 26.

When the cross beam 76 reaches the far edge of the pool, the magnets 120 open the limit switches 118. This removes voltage from the latching relay 98, which thereupon unlatches. The pool is thereby covered by the tarp 30 with only the momentary attention of an operator to initially actuate the latching relay 98. The operator need not remain to continue depressing the push button 86, since the self-latching contact 102 maintains the necessary contacts until the limit switches 118 are operated.

To open the pool cover of the invention, the operator need only momentarily depress the push button switch 88. This energizes the latching relay 100 to close the self-latching contact 110 and also to close contact 114. The momentary opening of the circuit between the base and emitter of the transistor 128, caused by movement of the push button 88, produces a pulse to pin 2 of the timing oscillator 130. After the oscillator 130 has timed out, an output pulse from pin 3 to relay 136 closes contacts 137. This completes a circuit from the 110–120 volt a.c. commercial power supply to energize the relay 122. Relay 122 closes contacts 124 and 126 to energize the motor 18, but only after the delay programmed by the adjustment of wiper 132 along resistor 134, which controls the timing of oscillator 130. Since relay 114 enables the solenoid washer 140 prior to closure of contacts 124 and 126, a sufficient head is built up in the cleaning water pipe 28 to begin cleaning the tarp 30 as it is wound on roller 32.

The cleaning water is sprayed onto the rear surface of the tarp 30 the tarp passes tangential to a vertical plane as it is wound on roller 32. The soiled cleaning water falls to the floor slab 46 and drains along the canted surface thereof beneath the drain aperture 48, carrying dirt, leaves, twigs and dead insects therewith. The soiled cleaning water falls through the grate 49 into the sump well 50. When the water in the sump well 50 reaches a sufficient level, the sump switch 53 is actuated through the transformer 142 to operate the relay 146. Relay 146 closes a contact 148 to energize a transformer 150. A rectifying network 152 and smoothing capacitor 154 provide low voltage d.c. current to the sump pump 52 to discharge the soiled cleaning water from the sump pump well 50 into a sewer line.

It should be understood that while but a single embodiment of the invention has been depicted herein, the scope of the invention should not be unduly restricted. Numerous variations and modifications to the invention will undoubtedly become readily apparent to those familiar with motorized swimming pool cover systems.

I claim:

1. In an automatic motorized device for selectively and reversibly drawing an expansive cover laterally across a swimming pool by lines attached thereto which are coiled on takeup reels, and alternatively retracting said cover onto a roller, the improvement comprising a single electric motor for moving said cover having a shaft rotatable in a single direction and coupled in electrical isolation to a nonconductive belt drive that rotates separate roller driving means and reel driving means in a common drive line, separately actuable electrical clutch means associated, respectively, with said roller driving means and said reel driving means, an alternating current input circuit of at least 110 volts coupled through motor contact means to said electric motor, step-down transformer means connected to said alternating current input circuit with a low voltage output circuit to provide low voltage current through clutch contact means to alternatively actuate only one of said electric clutch means, separately manually actuable switches and clutch contact actuating means, associated with each of said electric clutch means to couple a selected one of said electrical clutch means to said low voltage output circuit and to lock out said other electric clutch means therefrom, and motor contact actuating means operable by both of said manually actuable switch closure means to energize said electric motor, and further characterized in that limit switches are provided at opposite ends of said pool employing magnets which are forced in longitudinal movement responsive to movement of said cover, and reed switches are located in longitudinal registration with said magnets and arranged in circuit to operate said clutch contact actuating means and open said motor contact actuating means when said magnets are carried into proximity therewith, whereby said motor is used to alternatively cover and uncover said pool cover spraying means for spraying a cleansing spray of water onto said cover at said roller as said cover is retracted and passes downward at a vertical tangent as it is rolled onto said roller, and said cover spraying means is equipped with valve means and electrically actuated solenoid means for controlling said valve means, and said solenoid means is electrically coupled to said low voltage output circuit for operation by one of said manually actuable switches for initiating retraction of said cover, and a delay circuit is coupled in circuit with said solenoid means for delaying actuation of said solenoid means, whereby a head of water is allowed to build up in said cover spraying means before said solenoid means is allowed to open said valve means.

2. The device of claim 1 further characterized in that said clutch contact actuating means are separate latching relays associated with each of said manually actuable switches and said reed switches are separate limit switches associated with the positions of complete covering and uncovering of said pool, and are connected to unlatch an associated one of said latching relays, whereby momentary depression of a selected one of said manually actuable switches is used to alternatively cover and uncover said pool.

3. The device of claim 2 further comprising a manually actuable switch connected to manually unlatch both of said latching relays.

4. The device of claim 1 further characterized in that the sides of said pool are equipped with inwardly extending lips overhanging the water, and said lines extend into the sides of said cover to form beads therein, and said overhanging lips are equipped with downwardly depending tracks having inwardly facing C-shaped slots, whereby said beads of said cover are constrained to travel in said C-shaped slots.

5. The device of claim 4 further characterized in that said tracks include outwardly facing guides within which portions of said lines beyond said cover extend and within which said lines travel in a path parallel to the paths of travel of said beads, and said reels and said roller are located at a common end of said pool.

6. In an automated device employing a motor and means for manually actuating said motor for selectively and reversibly drawing an expansive cover laterally across a swimming pool by lines attached thereto which are coiled on takeup reels, and alternatively retracting said cover onto a roller, the improvement comprising cover spraying means for spraying a cleansing spray of water onto said cover as said cover is retracted, and including valve means and electrically actuated solenoid means for controlling said valve means, and a delay circuit is coupled to said solenoid means, and said delay circuit and said solenoid means are electrically coupled to said means for retracting of said cover, whereby a head of water is allowed to build up in said cover spraying means before said solenoid means is allowed to open said valve means, a bouyant transverse cross beam sewn into the leading edge of the cover, limit switches at both ends of said pool each comprising reed switches with magnets mounted proximate thereto for longitudinal movement relative thereto, and feeler rods extending outward toward the pool and toward said cross beam, whereby said leading edge of said cover floats on the surface of the water in said pool, and contacts at least one of said feeler rods when moved to either end of said pool to bring a magnet associated therewith into registration with the internal reed switch components thereof.

7. The device of claim 6 further comprising a well and sump pump therein located beneath said spray area separate from said pool, whereby spray water drains from said cover into said well for discharge by said sump pump.

8. The device of claim 7 further characterized in that said sump pump includes a low voltage sump switch and a low voltage d.c. sump motor, and said sump switch and said sump motor are operated by step-down transformer means from commercial electric a.c. power supply, thereby providing a guard against short circuits from said a.c. power supply.

9. The device of claim 7 further characterized in that said cover spraying means is actuated by a low voltage solenoid operated through a step-down transformer from a commercial electric a.c. power supply.

10. An automated motorized device according to claim 6 further characterized in that said delay circuit is coupled to delay actuation of said motor in retracting said cover.

* * * * *